United States Patent [19]

Ackerly et al.

[11] 3,964,989

[45] June 22, 1976

[54] APPARATUS FOR SUPPLYING CURRENT TO A MOVING STRIP

[75] Inventors: Robert E. Ackerly; Roy C. Bongartz, both of Pittsburgh, Pa.

[73] Assignee: Allegheny Ludlum Industries, Inc., Pittsburgh, Pa.

[22] Filed: Jan. 13, 1975

[21] Appl. No.: 540,379

[52] U.S. Cl. ..... 204/211; 204/28; 204/206; 204/207; 204/279

[51] Int. Cl.[2] ..... C25D 17/00; C25D 17/06; C25D 7/06

[58] Field of Search ..... 204/28, 206, 207, 211, 204/279

[56] References Cited

UNITED STATES PATENTS

| | | | |
|---|---|---|---|
| 1,583,741 | 5/1926 | Parker | 204/206 |
| 2,293,378 | 8/1942 | Allen et al. | 204/206 |
| 3,839,606 | 10/1974 | Paradine | 204/279 X |
| 3,865,701 | 2/1975 | Borgmann | 204/206 X |

*Primary Examiner*—John H. Mack
*Assistant Examiner*—A. C. Prescott
*Attorney, Agent, or Firm*—Vincent G. Gioia; Robert F. Dropkin

[57] ABSTRACT

Apparatus for supplying current to a moving strip includes a tank having an electrolyte and grids therein. The strip passes through the tank from a roll on the inlet side of the tank. A pair of conductor rolls bear on the strip in spaced apart relationship as it passes over the inlet roll. A D. C. power source has one side connected to the grids and the other side connected through separate leads to each end of each conductor roll. A current limit device may be provided in each lead.

7 Claims, 6 Drawing Figures

APPARATUS FOR SUPPLYING CURRENT TO A MOVING STRIP

This invention relates to apparatus for supplying electric current to a moving strip and more particularly to supplying direct current to strip made of steel such as stainless steel. It is common to supply electric current through a conductor roll to a strip in strip processing lines such as in electrolytic coating, plating, pickling and cleaning processes. In most, if not in all cases, the conductor roll is a strip supporting roll. Steel strip is not flat but commonly has waves especially at its edges. Other defects also occur especially at the edges. This results in poor contact between portions of the strip and the conductor roll with resultant heating. This is especially true when the conductor roll and strip are dry. Pinch rolls bearing against the outer surface of the strip have been used to help this condition, but are far from satisfactory.

Our invention is particularly suitable for passivation of bright annealed stainless steel strip. Prior to our invention this was done in apparatus which included a series of grids spaced apart longitudinally in a tank containing the electrolyte. The positive side of a direct current source was connected to those half of the grids at the entry end and the negative side to those half of the grids at the exit side of the tank. This operation was inefficient in that the passivation took place only in the exit half of the tank and there was also leakage of current between the positive and negative grids through the electrolyte. Thus, less than one half of the power was utilized.

In using contact rolls, especially with bright annealed stainless steel strip, electric resistance between the roll and strip varies greatly both longitudinally and transversely along the strip. This is due to dents, pits, dimples and oxide films on the strip. The oxide films are thick and non-uniform across the strip width. Thus possibility of overloads and resulting arcing is present.

It is therefore an object of our invention to provide apparatus which supplies electric current more uniformly to a moving strip.

Another object is to provide such apparatus which supplies the current more efficiently to a steel strip moving through an electrolyte.

These and other objects will be more apparent after referring to the following specification and attached drawings in which FIG. 1 is a schematic longitudinal view of a processing line having our invention incorporated therein;

Figure 1:
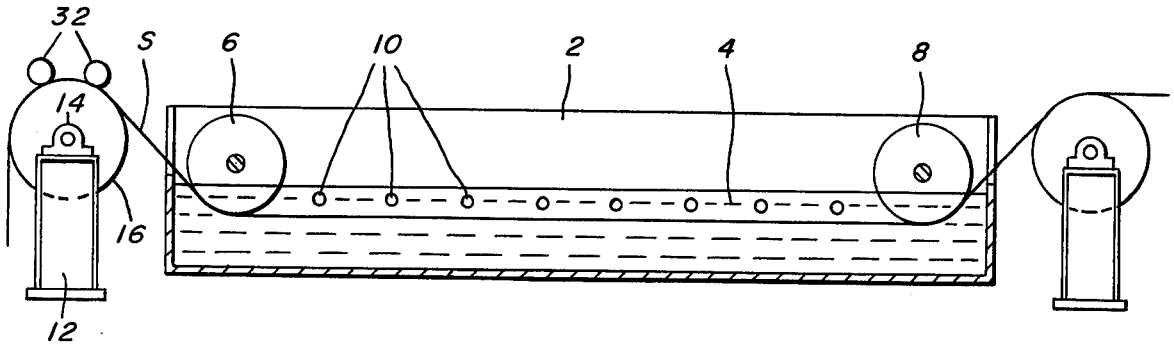

Referring more particularly to the drawings, reference numeral 2 indicates a tank containing an electrolyte 4 therein. A sink roll 6 is provided in the entry end of the tank and a similar roll 8 in the exit end. A plurality of grids 10 are provided in tank 2 in spaced apart relationship between rolls 6 and 8. Spaced apart bearing supports 12 are mounted outside the entry end of tank 2. Each support 12 has a bearing 14 mounted thereon. A rubber covered roll 16 rotatably supported in bearings 14 supports a strip S which passes around a substantial arc thereof and then into tank 2 under rolls 6 and 8. The strip S is preferably stainless steel. A bracket 18 is attached to each bearing support 12. A tube 20 which is fastened to the top of brackets 18 with its axis parallel to that of roll 16 rotatably supports a shaft 22. A support arm 24 is keyed to each end of shaft 22 with a pin 26 extending between the outer ends of arms 24. A frame 27 consisting of a sleeve 28 pivotally mounted on pin 26 and spaced apart plates 30 fastened thereto rotatably carries two conductor rolls 32, preferably made of solid steel having a hardened and polished surface. The axes of rolls 32 are parallel to the axis of roll 16. A pneumatic or hydraulic power cylinder 34 is provided on each side of bracket 18 with one end of each pivotally mounted on bracket 18 and its piston rod 36 pivotally attached to the adjacent arm 24.

Figure 4:
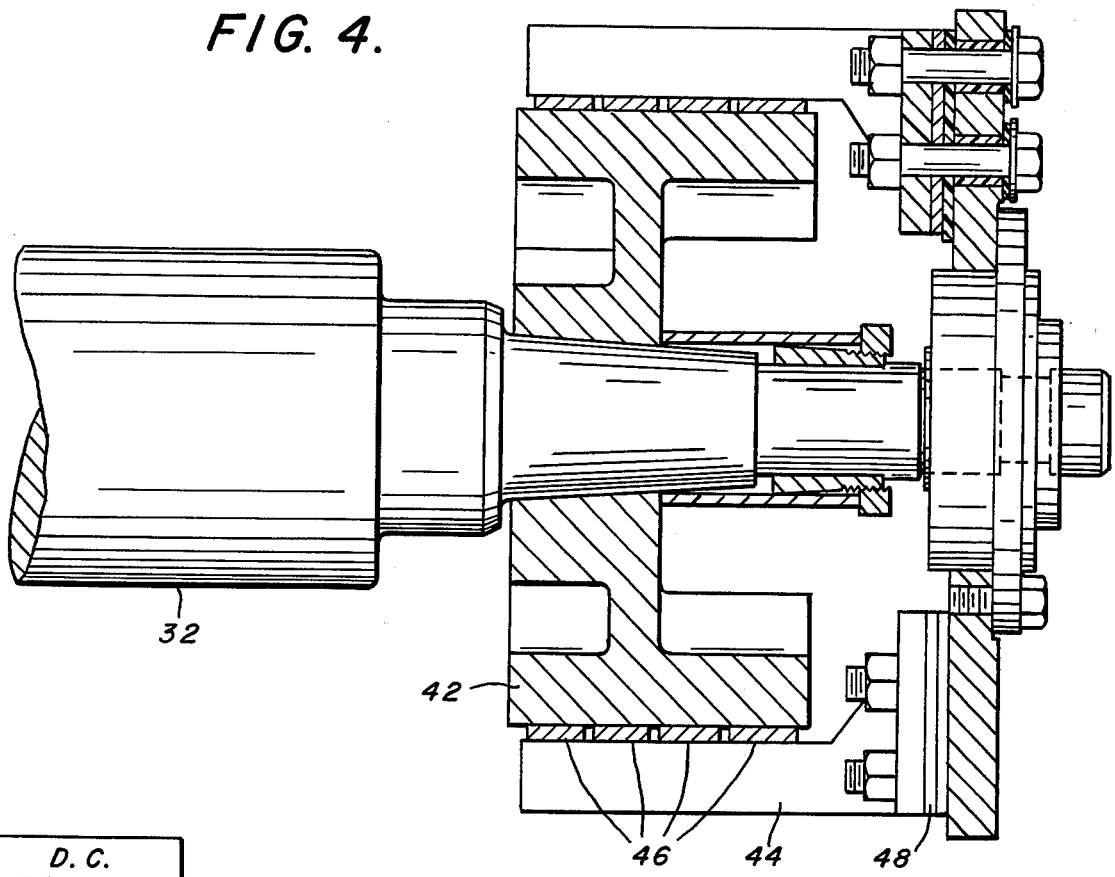
FIG. 4 is an enlarged sectional view of one end of a conductor roll showing the electrical connection thereto.
Figure 5:
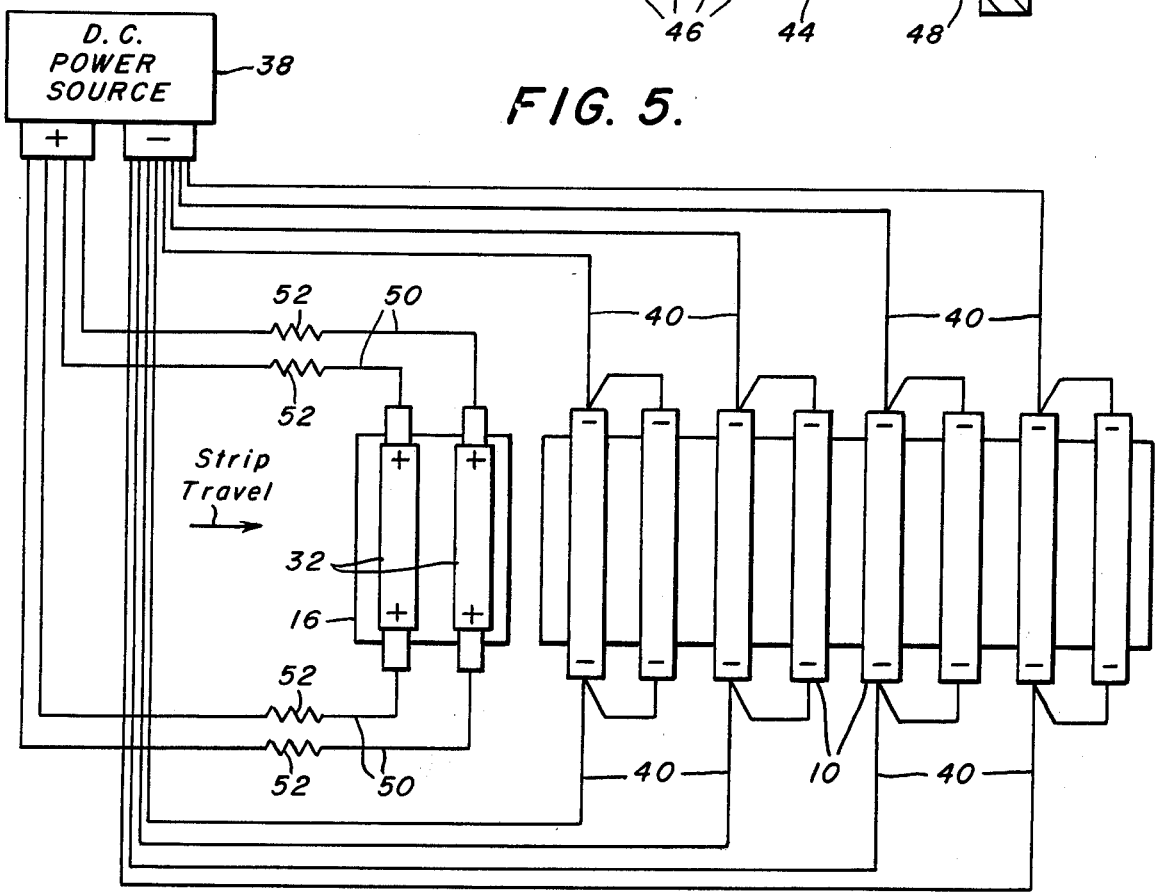
FIG. 5 is a schematic line diagram of our invention.

As best shown in FIGS. 4 and 5 direct current is supplied to the system from a D.C. power source 38 such as a rectifier. The negative side of power source 38 is connected to each end of grids 10 through leads 40. A copper ring 42 is mounted on each end of each roll 32. A copper brush holder 44 surrounds each ring 42 and supports brushes 46 in contact with ring 42. A copper bus 48 is connected to holder 44. A lead 50 connects each bus 48 to the positive terminal or rectifier 38. A resistance 52 may be connected in each lead or the resistance may be provided by designing the lead to give the proper resistance. As shown schematically in FIG. 6 reference numeral 54 represents the resistance of the brushes and commutator ring. The proper lead resistance 52 is selected to be at least 10 times greater than commutation resistance 54. This permits current to be equally divided to each end of each roll despite changes in commutation resistance 54. Current flow is from the ends of each conductor roll toward the center of the strip. Reference numeral 56 is the resistance of an increment of the conductor roll body. Increments of roll body are taken starting from the strip edge and are of equal length making incremental resistances 56 equal. Reference numerals 58*a*, 58*b*, 58*c*, 58*d*, 58*e*, 58*f*, 58*g* and 58*h* are the local strip surface resistances at each roll increment. While four increments are shown in the drawing for each roll the number may vary. Local strip surface resistance will vary depending on strip surface conditions. The following calculations are based upon the use of seven increments for each half of each roll. The equivalent resistance for each half roll can be calculated once magnitudes of the individual increment resistances are established. For a two inch roll increment resistance 56 would normally be $6 \times 10^{-6}$ ohm. Three different cases using a different magnitude of strip surface resistance demonstrates the effect of strip surface resistance on the equivalent resistance of roll and strip. as being $6 \times 10^{-6}$ ohm. In this case the equivalent resistance is $3.71 \times 10^{-6}$ ohm for each half roll.

In the second case the strip surface resistance is increased to $6 \times 10^{-5}$ ohm which makes the equivalent resistance $1.67 \times 10^{-5}$ ohm for each half roll.

In the third case the strip surface resistance is increased to $6 \times 10^{-4}$ ohm which makes the equivalent resistance $9.64 \times 10^{-5}$ ohm for each half roll.

Figure 6:
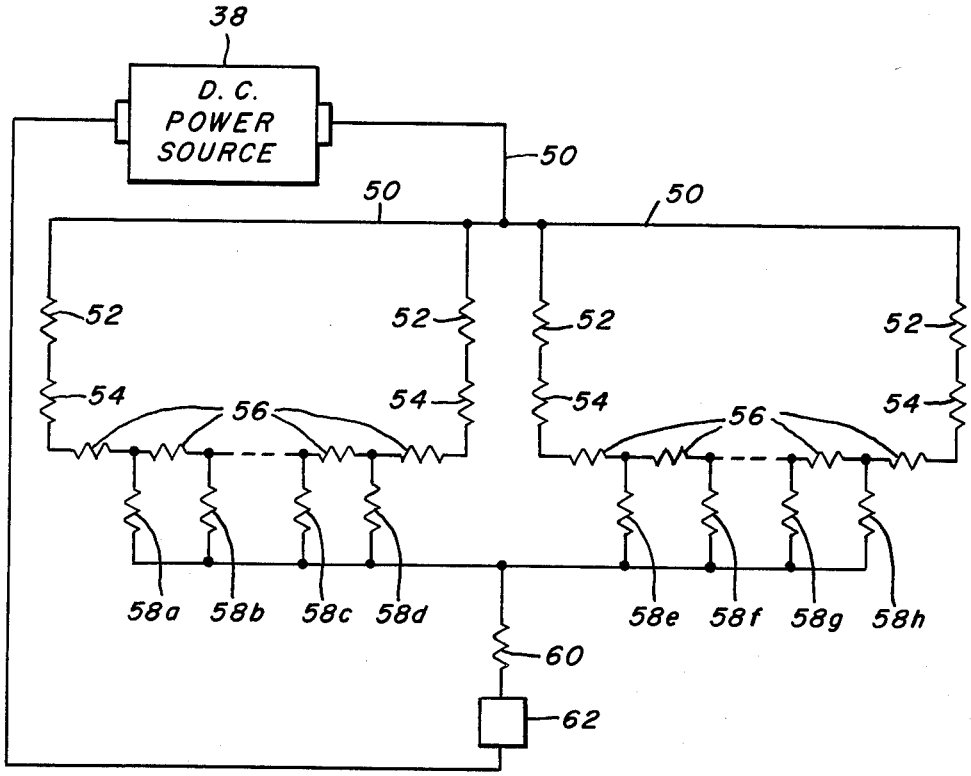
FIG. 6 is a schematic view indicating the various resistances present in a processing line of our invention.
Figure 3:
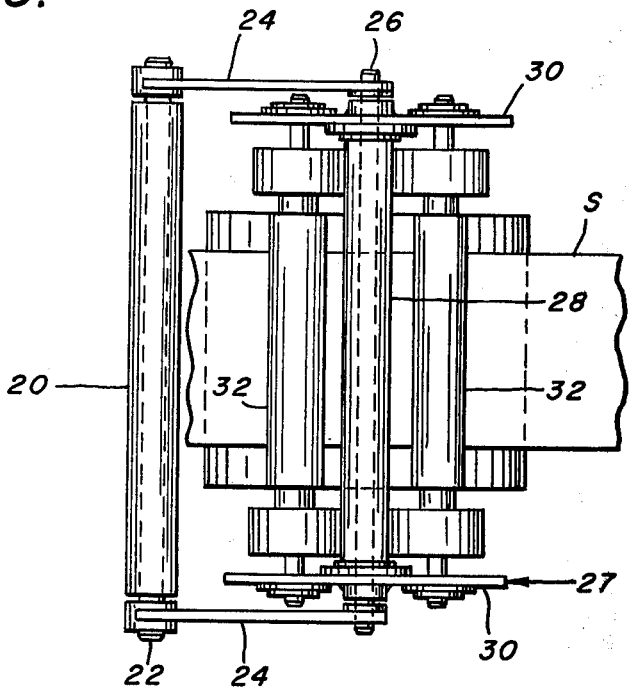
FIG. 3 is a top plan view of FIG. 2.

With the equivalent resistance determined for a particular case the schematic of the entire system is shown in FIG. 6. The circuits for both conductor rolls 32 are shown. It will be seen that each roll has a circuit representation of a resistance bridge. The sum of resistances 52 and 54 form two arms of the bridge for each roll. The sum of these resistances remaining constant during operation of the device is $4 \times 10^{-3}$ ohm. The equivalent resistance of each half roll and strip interface forms the resistances of each of the two remaining arms. This resistance may change during operation of the device. The connecting resistance is the total of resistance 56 of the conductor roll over the middle of the strip. When the bridge is balanced the current in each arm (each half of the roll) is equal and the current through the connecting resistance is zero. Under a balanced condition current flow is through the ends of the conductor roll to each edge of the strip. Current flow from one end of the roll would be conducted to its respective edge of the strip.

However, since the conductor roll is continuous over the entire width of strip the portion of the roll over the center of the strip forms the connecting resistance between the two arms of the resistance bridge. This resistance is approximately $3 \times 10^{-6}$ ohm.

In an unbalanced condition the equivalent strip resistance would be unequal to its corresponding resistance on the other arm permitting current flow through the roll.

If the magnitude of the equivalent resistance in one arm increases two fold over its normal balanced resistance the bridge will be unbalanced such that about 15% of total current delivered to the conductor roll will pass across the roll. If the magnitude of the resistance in one arm should increase ten fold more than corresponding resistance in the other arm then this unbalance would result in 40% of the current delivered to the conductor roll passing through the connecting resistance of the conductor roll. The magnitude of the equivalent resistance does not greatly affect the fraction of current passing through the connecting resistance under unbalanced conditions. Reference numeral 60 is the strip resistance between the contact rolls and the load which requires the electrical power to process the strip, and reference numeral 62 the impedance of the load in the process. A current regulator means such as a circuit breaker may be used in series with resistances 52 and 54.

Figure 2:
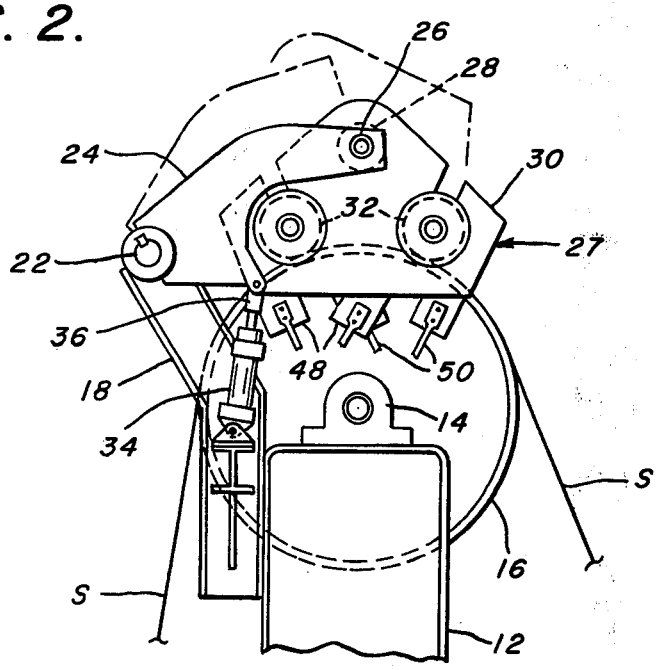
FIG. 2 is a side elevation of the conductor rolls and mounting thereof.

In operation, pressure is applied to the lower end of cylinders 34 to raise arms 24 and frame 27 to the upper broken line position shown in FIG. 2. The strip S is then threaded through the processing line as shown in FIG. 1. Pressure is then applied to the upper end of cylinders 34 to lower frame 27 and brings rolls 32 into contact with the top of the strip S. The pressure of the fluid may be varied to control the contact pressure of rolls 32 on strip S. As the strip S is pulled through the processing line it will cause rotations of rolls 16 and 32 and power will be supplied to strip S from rolls 32. Since the rolls 32 are spaced apart longitudinally of the strip a distance of several inches, edge damage or waves in the strip that cause the strip to have poor contact with one conductor roll will have little likelihood of causing poor contact with the other conductor roll. Thus more uniform supply of current to the strip results.

In passivation of a stainless steel strip, current passes from rectifier 38, leads 50, buses 48, brushes 46 and collector rings 42 to each end of each of the rolls 32. The current then passes through the strip S to the electrolyte and then to the grids 10. For the same length of tank and the same grids as in the prior system less than half the amount of current is needed to obtain the same passivation.

In coating operations the polarity connections will be reversed.

While one embodiment has been shown and described, it will be readily apparent to those skilled in the art that various adaptations and modifications may be made within the scope of the invention.

We claim:

1. Apparatus for supplying electric current to a moving strip comprising a strip support roll having a length at least as great as the width of the strip, means directing said strip around a substantial arc of said support roll, a pair of rotatable conductor rolls having a length at least as great as the width of the strip, means mounting said pair of conductors rolls in spaced apart relationship around the outer periphery of the support roll with their axes parallel to the axis of the support roll and their periphery in engagement with said strip where it is in contact with said support roll so that said strip is held for its full width between said support roll and one of said conductor rolls and and then between said support roll and the other of said conductor rolls, and means for supplying electric current to said conductor rolls.

2. Apparatus according to claim 1 in which said conductor roll mounting means includes a movable frame for rotatably supporting both of said conductor rolls, and means for moving said frame toward and away from said support roll.

3. Apparatus according to claim 1 in which said conductor roll mounting means includes a movable frame for rotatably supporting both of said conductor rolls, a stationary bracket, a support arm having one end pivotally connected to said bracket and the other end pivotally connected to said frame, and means for moving said frame and support arm about their pivots.

4. Apparatus according to claim 3 in which said moving means includes a fluid cylinder having a piston rod operable thereby, means pivotally connecting the outer end of said piston rod to one of said frame and bracket, and means pivotally connecting the end of said cylinder opposite said piston rod to the other of said frame and bracket.

5. Apparatus according to claim 1 in which said means for supplying electric current to said conductor rolls includes a direct current power source, a lead from one side of said direct current source to each end of each conductor rolls, and current regulator means in each of said leads.

6. Apparatus according to claim 1 in which said support and conductor rolls are cylindrical over the full width of the strip.

7. Apparatus according to claim 6 in which said electric current is direct current and the said conductor rolls are of the same polarity.

* * * * *